US006989659B2

(12) United States Patent
Menegoli et al.

(10) Patent No.: US 6,989,659 B2
(45) Date of Patent: Jan. 24, 2006

(54) LOW DROPOUT VOLTAGE REGULATOR USING A DEPLETION PASS TRANSISTOR

(75) Inventors: Paolo Menegoli, San Jose, CA (US); Carl K. Sawtell, San Jose, CA (US)

(73) Assignee: Acutechnology Semiconductor, San Jose, CA (US)

( * ) Notice: Subject to any disclaimer, the term of this patent is extended or adjusted under 35 U.S.C. 154(b) by 0 days.

(21) Appl. No.: 10/427,384

(22) Filed: May 2, 2003

(65) Prior Publication Data

US 2004/0046532 A1 Mar. 11, 2004

Related U.S. Application Data

(60) Provisional application No. 60/409,040, filed on Sep. 9, 2002.

(51) Int. Cl.
*G05F 1/56* (2006.01)

(52) U.S. Cl. ..... 323/274; 323/275; 323/316

(58) Field of Classification Search ..... 323/270, 323/273–275, 311–316
See application file for complete search history.

(56) References Cited

U.S. PATENT DOCUMENTS 4,590,396 A * 5/1986 Koike ..... 326/24
5,168,175 A * 12/1992 Endo ..... 327/430
5,506,496 A 4/1996 Wrathall
5,631,598 A 5/1997 Miranda
5,686,821 A 11/1997 Brokaw
5,804,956 A * 9/1998 Pulvirenti ..... 323/277
6,005,378 A * 12/1999 D'Angelo et al. ..... 323/313
6,300,749 B1 10/2001 Castelli
6,373,233 B2 4/2002 Bakker et al.
6,380,769 B1 * 4/2002 Hall et al. ..... 327/112
6,498,367 B1 * 12/2002 Chang et al. ..... 257/341
6,522,111 B2 * 2/2003 Zadeh et al. ..... 323/277
6,586,916 B2 * 7/2003 Kalpakjian et al. ..... 323/268

OTHER PUBLICATIONS

Michael R. Lindeburg, "Engineer-In-Training Reference Manual", p. 51-13.*
Robert J. Widlar "New Developments in IC Voltage Regulators" IEEE Journal of Soild State Circuits, vol. 6, No. 1, Feb. 1971.
Operating and Service Manual for Model 712B Power Supply, Hewlett Packard Company, Palo Alto CA, 1954, no month.
W. Jung "Low-Dropout Regulators", Analog Devices, no date.
Burr-Brown REG101 Specification, Texas Instruments, Jul. 2001.
Philips SA57000-XX specifications, Philips Semiconductors, Oct. 2001.
W. Jung "Low-Dropout Regulators", Analog Devices, no date.

* cited by examiner

*Primary Examiner*—Gary L Laxton

(57) ABSTRACT

A linear low dropout voltage regulator is described that makes use of a depletion mode NMOS pass transistor and of a PMOS transistor in series to the NMOS transistor and connected to its drain. The depletion NMOS transistor assures low dropout operations, while the series PMOS transistor allows the current regulation even under the condition of shorted load. The same PMOS transistor may be used to disable the current in the load without generating a negative voltage at the gate of the depletion pass transistor. This regulator is inherently stable without the need for an output capacitor in parallel to the load.

4 Claims, 9 Drawing Sheets

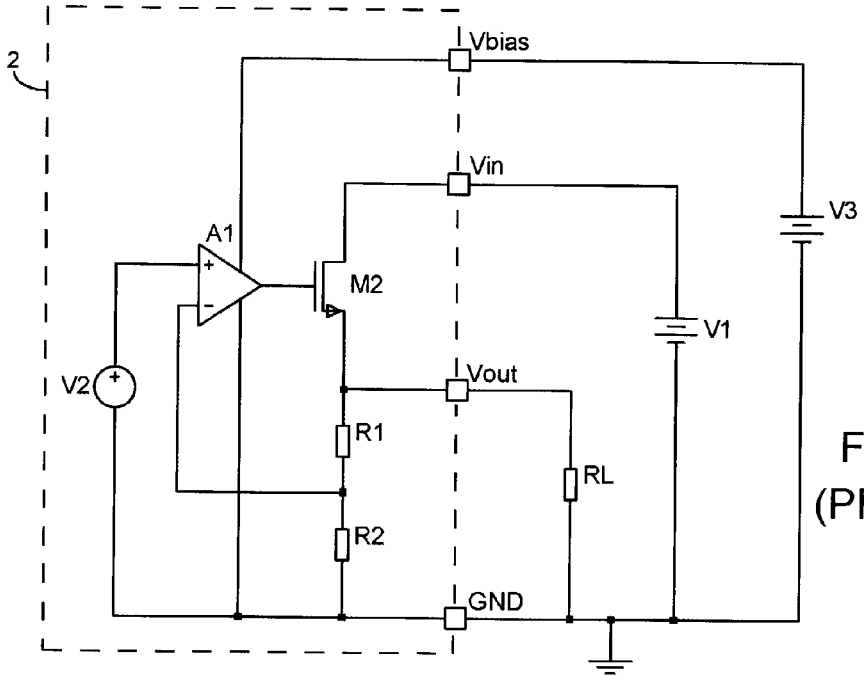
FIG. 2-A
(PRIOR ART)
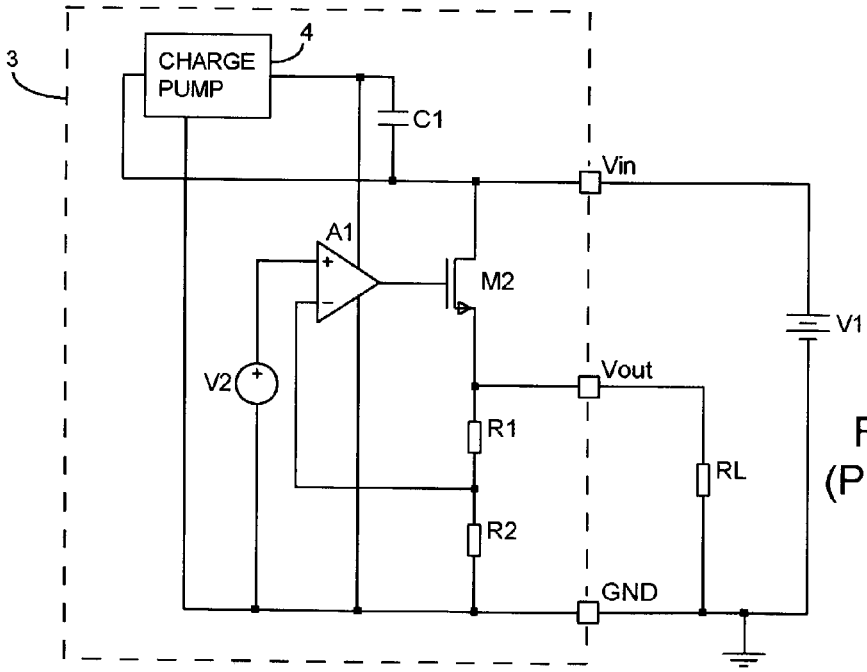
FIG 2-B
(PRIOR ART)

LOW DROPOUT VOLTAGE REGULATOR USING A DEPLETION PASS TRANSISTOR

RELATED APPLICATION DATA

The present application claims priority from U.S. Provisional Patent Application No. 60/409,040 for LOW DROPOUT VOLTAGE REGULATOR USING A DEPLETION PASS TRANSISTOR filed on Sep. 9 2002.

BACKGROUND OF THE INVENTION

1. Field of the Invention

The present invention is in the field of electronic circuits. The present invention is further in the field of analog integrated circuits. The implementation is not limited to a specific technology (i.e. CMOS or bipolar), and applies to either the invention as an individual component or to inclusion of the present invention within larger systems which may be combined into a larger integrated circuit.

The invention also falls within the field of DC voltage regulators and electronic power supplies, which convert energy from one DC level to another. These devices have been common in all electronic systems. More specifically, the invention falls into the class of voltage regulators referred to as series pass regulators or low dropout regulators, which convert a higher voltage to a lower voltage.

2. Brief Description of Related Art

Integrated circuit voltage regulators are common components which typically have an input terminal for receiving an input voltage, a common (ground) terminal, and an output terminal which supplies current to a load. The output terminal provides a substantially fixed voltage independent of the magnitude of the input voltage or the current provided to a load, provided that the input voltage is greater in magnitude than the desired output voltage.

Although many integrated circuit regulators provide this function only, it is common to provide additional functions in order to protect the circuitry and/or the load. It is usual to provide a mechanism to limit the maximum current the regulator will present the load. Many regulators also provide a means for disabling the output current, allowing an external enable/disable signal to determine whether the load will be powered. This is typical in large electronic systems with many individual functional blocks, where it may be desirable to selectively turn off those blocks to reduce power consumption when they are not required. Additional protections, such as over-temperature shutdown, are also common.

Available regulators can be characterized as either shunt regulators, which place a dissipative element in parallel with the load and control the shunted current to control the output voltage, or series pass regulators, which place a dissipative control element directly between the input voltage and the load. The latter technique has the advantage of being significantly more efficient than the shunt variety, and is the dominant approach used among integrated circuit regulators, and is the technique used in the present invention.

Among series pass regulators, there are two general classes. Conventional regulators use series pass elements which are unity gain followers (emitter followers or source followers), typically NPN or NMOS devices. This class of conventional regulator, in its integrated circuit form, is well described in "New Development in IC Voltage Regulatiors" (IEEE Journal of Solid States Circuit, vol. 6, no. 1 February 1971) by R. J. Wildlar. In order to drive the base or gate terminals, respectively, of these devices, the controlling signal must be higher in magnitude than the output voltage.

This control signal requirement limits the "dropout voltage", the difference between the input and output voltage of the regulator. In order to remove this limitation, a class of devices referred to as "LDO" or Low DropOut regulators was developed which used common emitter or common source output stages, typically PNP or PMOS transistors. The prior art circuit 1 using the PMOS transistor is shown in FIG. 1. Because the control signal (base or gate voltage) of these devices swings negative with respect to the emitter or source terminals, this control signal is not limited by the input voltage and it is possible to operate these devices with extremely small differences between input and output voltages.

Although the low dropout of the standard LDO circuits is very desirable, this architecture has some severe limitations in performance. The conventional regulator (using NPN or NMOS pass transistor) typically has much lower output impedance. The LDO typically requires a large capacitor at the output to maintain stable operations. Many LDOs are sensitive not only to the magnitude of capacitance across the load, but also to whether that capacitor looks like an ideal capacitor or whether it has a series resistive component at high frequencies. Selecting the wrong capacitor (too large or too small, too much series resistance or too little) can cause the LDO to oscillate.

The overall architecture of the series pass regulator is typically that of a feedback amplifier (as disclosed in the book "Analog Devices" in the chapter "Low-Dropout Regulators" by W. Jung). As shown in FIG. 1 such a regulator 1 includes an error amplifier A1 having an output connected to a gate terminal of the power transistor M1. A reference voltage generator V2 is amplified by a high gain feedback amplifier. As with all feedback systems, the performance is improved by increasing gain, but with a requirement that gain be rolled off at high frequencies in order to maintain the stability of the feedback loop. The mechanism for so limiting the high frequency gain is referred to as "compensation" and is of key importance in the design of all feedback systems.

In conventional regulator systems using unity gain follower outputs, the typical stabilization mechanism is to use a three stage amplifier. The first stage is a fixed transconductance, the second is a voltage gain stage, typically very high gain, which then drives a unity gain follower output stage. A feedback capacitor from the output or from the input to the follower, or both, is connected back to the output of the transconductance stage. This feedback around causes a dominant low frequency pole. This architecture is identical to the traditional feedback used in operational amplifiers.

Because this architecture has inherently low output impedance, which is further lowered by feedback, the system is relatively insensitive to loading. The reduction in feedback with increasing frequency can make the effective output impedance rise with frequency, causing it to look inductive. This inductive output impedance can, under certain circumstances, interact with capacitive loading to reduce the stability of the system, but the systems are generally very wideband and load insensitive.

The standard LDO is quite different in its frequency compensation. Typically the amplifier has two or three stages. An input stage compares a measure of the output voltage to the voltage reference. This stage may drive intervening stages, but eventually controls the common source/emitter output device. That final power stage provides voltage gain as a function of its transconductance and the load impedance (Av=gm*ZL). Since the load typically includes a capacitive component, that capacitor can be used to provide some of the gain reduction at high frequencies needed for stability. But typically the load capacitance is controlled by system requirements other than optimizing the stability of the LDO. It is therefore desirable to make the LDO stable over a wide range of capacitances.

It is not possible to use existing commercial LDOs without a large capacitive load (equal to or exceeding 1 uF). This results in the control loops of most LDOs being relatively slow. Since the LDO has very high output impedance without feedback, and a relatively low gain at high frequencies, it cannot maintain its output voltage in the presence of fast load changes.

To date, the primary approach to reduce the output capacitance sensitivity of the LDO has been to optimize the frequency compensation. Miranda (U.S. Pat. No. 5,686,821) and Brokaw (U.S. Pat. No. 5,631,598) use local capacitive feedback around the output devices and the driver stages to make these stages behave in a manner more similar to conventional output circuits using followers. Bakker et. al (U.S. Pat. No. 6,373,233) provided a somewhat similar solution, using a distributed RC network or its lumped equivalent around the output device alone.

Castelli et. al (U.S. Pat. No. 6,300,749) introduced a solution to add a mobile zero in the compensation circuit that is dependent on the second output pole of the LDO.

In all these cases the disadvantage is the need for an output capacitor to guarantee stability and adequate filtering of the output voltage.

There have been limited attempts to directly implement the older, faster control scheme in LDOs. One means of doing so is implemented in the UC385 regulator from Unitrode (now Texas Instruments). This regulator, element 2 in FIG. 2A, requires the introduction of a second higher voltage supply voltage V3 from which to run the control circuit. Power flows from the input supply V1 to the load with very low dropout voltage, but the gate/base drive of the pass transistor M2 is generated from the higher voltage supply. In principle, this second, higher voltage supply could be generated by the regulator 3 using a means such as a charge pump 4, as shown in FIG. 2B, but this would create unwanted noise and would delay startup until this required rail is generated. Such a regulator was introduced by Burr-Brown (now Texas Instruments), the REG101 and more recently by Philips, the SA57000-XX.

A more useful approach is the application of depletion mode power devices as pass transistors. Depletion mode devices are those where the turn-on threshold of the device is of a magnitude that zero control voltage allows the device to be conducting. JFETs and vacuum tube devices are inherently depletion mode devices, whereas bipolar transistors are inherently enhancement mode devices, inherently "off" with their control (base) pin held at the same potential as the emitter. MOSFETs can be made either enhancement or depletion by adjusting the surface concentration of the channel region. Most production CMOS processes include ion implantation steps to adjust the threshold of NMOS and PMOS devices to a desired threshold, typically a fraction of a volt. But an additional selective implant into devices destined to be depletion FETs can easily alter the threshold such that it is negative, forming depletion devices. This allows a standard CMOS process, with one additional mask step, to include depletion mode devices. Any process flow that builds enhancement mode MOSFETs can be modified slightly to provide depletion mode devices.

Wrathall et. al (U.S. Pat. No. 5,506,496) is an example of the use of depletion mode MOSFETs. There are several problems with the use of depletion mode pass devices, which are normally "on" and must have a negative voltage applied to their control terminal to turn them off. One problem is that under a condition of shorted load, where the output is at ground potential, the device will be on and cannot be turned off without the application of a negative gate voltage. Another potential problem with using depletion mode devices is that they are uncontrolled when voltage is initially applied. This causes the output voltage to be identical to the input voltage at start-up. Only after sufficient voltage exists to hold the gate below the source (output) by a voltage greater than the threshold voltage of the FET can any measure of control be imposed.

Wrathall's solution, to both problems, shown in FIG. 3, element 4, was a regulator 4 with PMOS device M3 as a switch in series with the source of the depletion mode MOSFET MD1. A switch control circuit 5 can selectively turn off PMOS device M3 in order to turn off current to the load. This implementation is not the ideal configuration, because in the condition of very low dropout voltage, it is necessary to fully enhance both NMOS and PMOS devices, i.e. maximizing the voltage from gate to source. When the regulated voltage is low, the PMOS device M3 in Wrathall cannot be fully enhanced. Similarly, by tying the source of the NMOS MD1 to the source of the PMOS M3, the Vgs which can be applied to the depletion NMOS is reduced resulting in increased total on resistance or bigger die area.

An earlier precedent for using "normally-on" devices comes from early regulator designs using thermionic devices (vacuum tube triodes and beam power pentodes). Vacuum tubes, like modern depletion FETs, were normally on with their control terminal (grid) held at the cathode voltage. By pulling the grid negative, the device could be turned off. A 1954 circuit for the HP 712B power supply, depicted in FIG. 4, shows very similar architecture to the conventional solid state series pass regulators discussed here. The gas discharge device U8 provides a voltage reference, a feedback amplifier comprising four triodes U1 through U4 compares this reference to a voltage divider taken from the output, and the amplifier drives a pass device U5, a beam power pentode. Note that as in the LDOs formed from enhancement devices in FIG. 2, this circuit requires a multiplicity of bias voltages, V5 and V6, in addition to the primary input voltage V4. Like the regulator using depletion MOSFET devices as in FIG. 3, this circuit required a switch SW1 that could keep the load disconnected during start-up, as the output voltage could rise to an uncontrolled high voltage before the active circuit could control it.

Accordingly, what is needed is a low dropout voltage regulator that combines the features of inherent stability, the ability to turn on and off very swiftly, the possibility to include a reliable means for limiting the output current and more importantly the capability to react extremely quickly to a change in load conditions. This would allow operation without the need for the output capacitor to filter the output voltage spikes and to provide stability to the control loop.

SUMMARY OF THE INVENTION

The present invention provides a fast LDO regulator which is insensitive to capacitive loads. This insensitivity allows the LDO to be used without requiring a capacitive load or, if a capacitive load is used, without imposing requirements on the value or quality of that capacitor. The fact that the LDO may be used without requiring an output capacitor, in some applications where it is required to turn off and on the regulator often to save energy stored in the batteries, such as in cellular phones, is a significant advantage because the energy stored in the output capacitor during the on time, is then left in the capacitor at the turn off. If the off time is long enough, due to the natural current leakage present in any capacitor, the capacitor discharges itself, resulting in energy wasted at every cycle. In addition the removal of the output capacitor improves the reliability of the overall system and reduces substantially the physical size and the system cost.

Because of its high speed, this present invention improves significantly upon the precision of the output in the presence of fast transients changes in the load current. One of the advantages of the described configuration is the fact that the higher intrinsic stability and better frequency response allows a potentially higher DC gain resulting in a much better load regulation with respect to a more traditional low drop-out linear regulator.

Furthermore in a configuration where the back gate of the depletion transistor is tied to the substrate of the IC (most common configuration of CMOS processes) the intrinsic body diode between input and output is eliminated and this could be advantageous in some applications.

A simple implantation allows the addition of a depletion transistor to any CMOS process without increasing the overall cost of the regulator.

The most general embodiment for the low dropout voltage regulator using the depletion type field effect transistor as main pass element is shown in FIG. 5.

The linear regulator 6 comprises a voltage control circuit 7 to control the voltage at the gate of the transistor MD1 in order to regulate the voltage at the load.

Furthermore a current control circuit 8 controls the voltage applied to the gate of PMOS device MP1 in order to control the current to the load.

According to the embodiment of the present invention, the depletion pass transistor MD1 is configured as a follower to allow the gate voltage to regulate the voltage at its source. Its back gate could be shorted to the source, but in a more common embodiment is connected to the substrate of the device.

The PMOS MP1 connected in series to the drain of MD1 allows for a complete shutdown of the regulator that otherwise would not be possible due to the negative threshold voltage of MD1. Furthermore MP1 could be regulated linearly to control accurately the current in the load providing a current limit function. This current limit could be a fixed one or could also be made a function of the output voltage as used in techniques referred to as "fold-back" current control.

According to the general embodiment of the present invention as shown in FIG. 6, a low dropout regulator with an input terminal Vin and output terminal Vout is provided consisting of a voltage reference V2, a differential error amplifier A1 comparing said reference to a measure of the output voltage, and a depletion mode FET MD1 which has its gate driven by the error amplifier output and its source tied to the Vout terminal. The drain of the depletion mode FET MD1 is connected to the drain of a PMOS MP1. The PMOS transistor has its source connected to the input terminal Vin and its gate tied to a control generator of function to be described, which under normal operation holds the PMOS switch in an "on" state.

In typical operation, the present invention operates similarly to the regulators described above of conventional design, but with the low dropout capability of an LDO. The use of a depletion mode device as a pass element removes the requirement of an input voltage which is substantially greater than the desired output voltage.

In normal operation, the PMOS MP1 switch is fully enhanced. This placement of the PMOS device has significant advantage over prior art Wrathall. When the regulator is being operated with substantial voltage between input and output, this configuration provides the benefit that the PMOS resistance is in the drain circuit of the NMOS pass device, rather than in series with the source. This allows for lower open loop output impedance, which improves performance.

The control circuit for the PMOS MP1 additionally is used to control fault conditions. In the case of a shorted load, where the output terminal is at ground potential, it is not possible to drive the gate of the depletion device below ground to reduce the output current. Under this condition, the PMOS can be programmed to operate at a fixed current which will control the current through the depletion NMOS or with a current dependent on the regulated output voltage providing the benefits of current fold-back technique to limit the power in the pass transistor in case of shorted load. In addition, it is possible to turn the PMOS MP1 transistor off to provide a "shutdown" mode where the LDO provides no current in the load. This shutdown mode may either be contingent on a fault (such as temperature exceeding a fixed threshold or input voltage exceeding a threshold) or it may be used to provide a system-level control of power to the load.

In a preferred embodiment of the present invention as shown in FIG. 7, the operational amplifier A2 drives the gate of the PMOS transistor MP3, which in its turn controls the voltage at the gate of the PMOS transistors MP1 and MP2.

In further embodiment of the present invention as shown in FIG. 8, the error amplifier and the reference voltage generator are combined in the classical Bandgap circuit 10 comprising transistors Q1, Q2, Q3 and Q4.

A further embodiment of the present invention shown in FIG. 9 presents a different type of voltage reference for use with CMOS process technologies. In addition an operational amplifier A3 acts as a voltage shifter to generate a replica of the voltage at the drain of MP3 to the gate of the transistors MP1 and MP2.

BRIEF DESCRIPTION OF THE DRAWINGS

Further details of the present invention are explained with the help of the attached drawings in which:

FIG. 2A is a circuit diagram showing a prior art NMOS LDO regulator implemented with the use of an external higher voltage source generator to drive the gate of the pass transistor;

FIG. 2B is a circuit diagram showing a prior art NMOS LDO regulator implemented with a charge pump circuit to generate a voltage drive for the gate of the pass transistor;

DETAILED DESCRIPTION OF SPECIFIC EMBODIMENTS

A. FIG. 5

Figure 1:
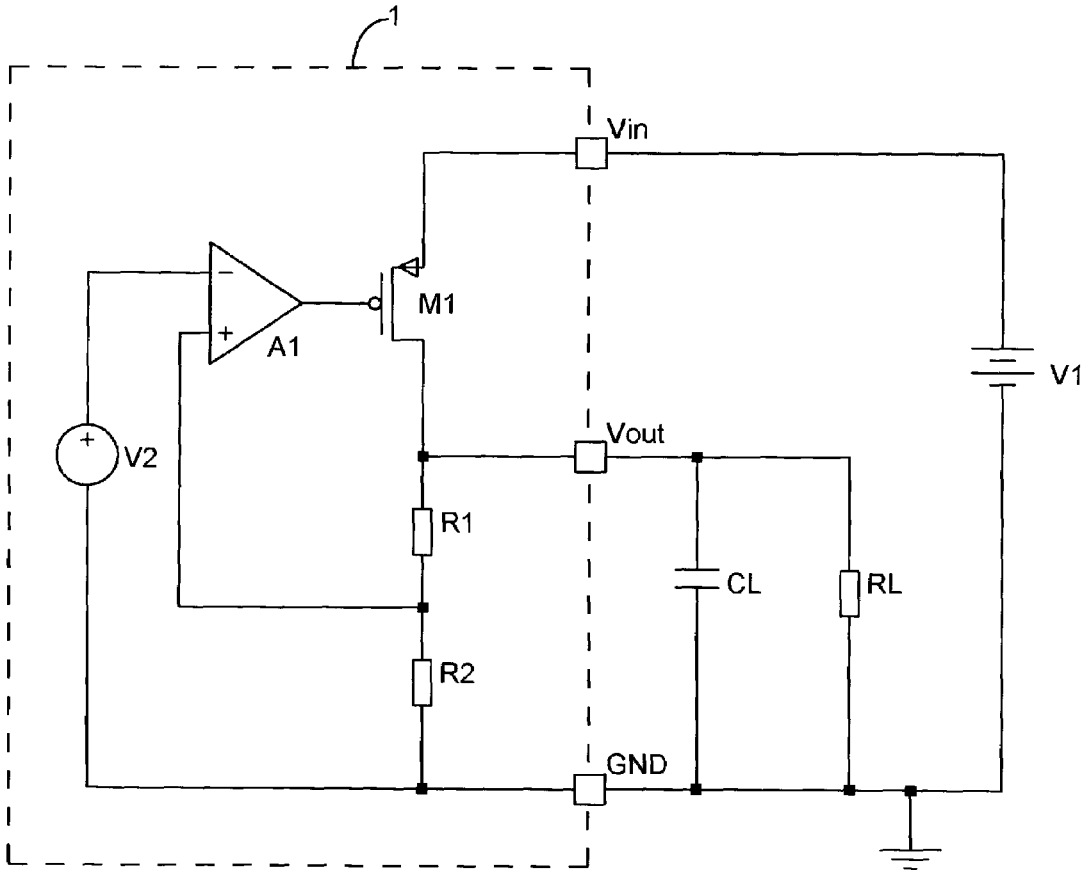
FIG. 1 (PRIOR ART)
FIG. 1 is a circuit diagram showing the prior art of PMOS Low DropOut voltage regulator.
Figure 3:
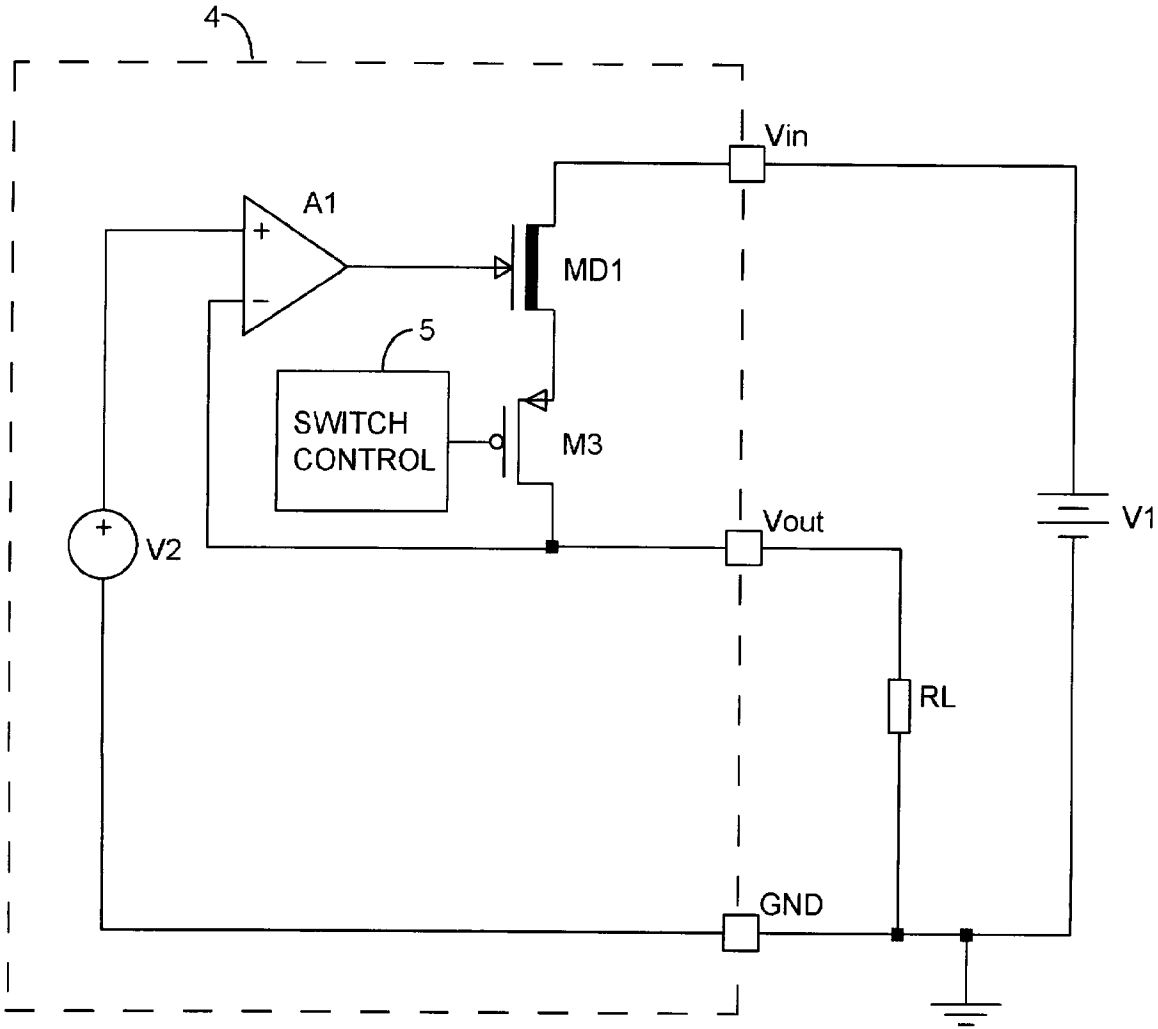
FIG. 3 (PRIOR ART)
FIG. 3 is a circuit diagram showing a prior art depletion NMOS LDO regulator implemented with a PMOS switch in series to the source of the NMOS as in Wrathall's patent description.
Figure 4:
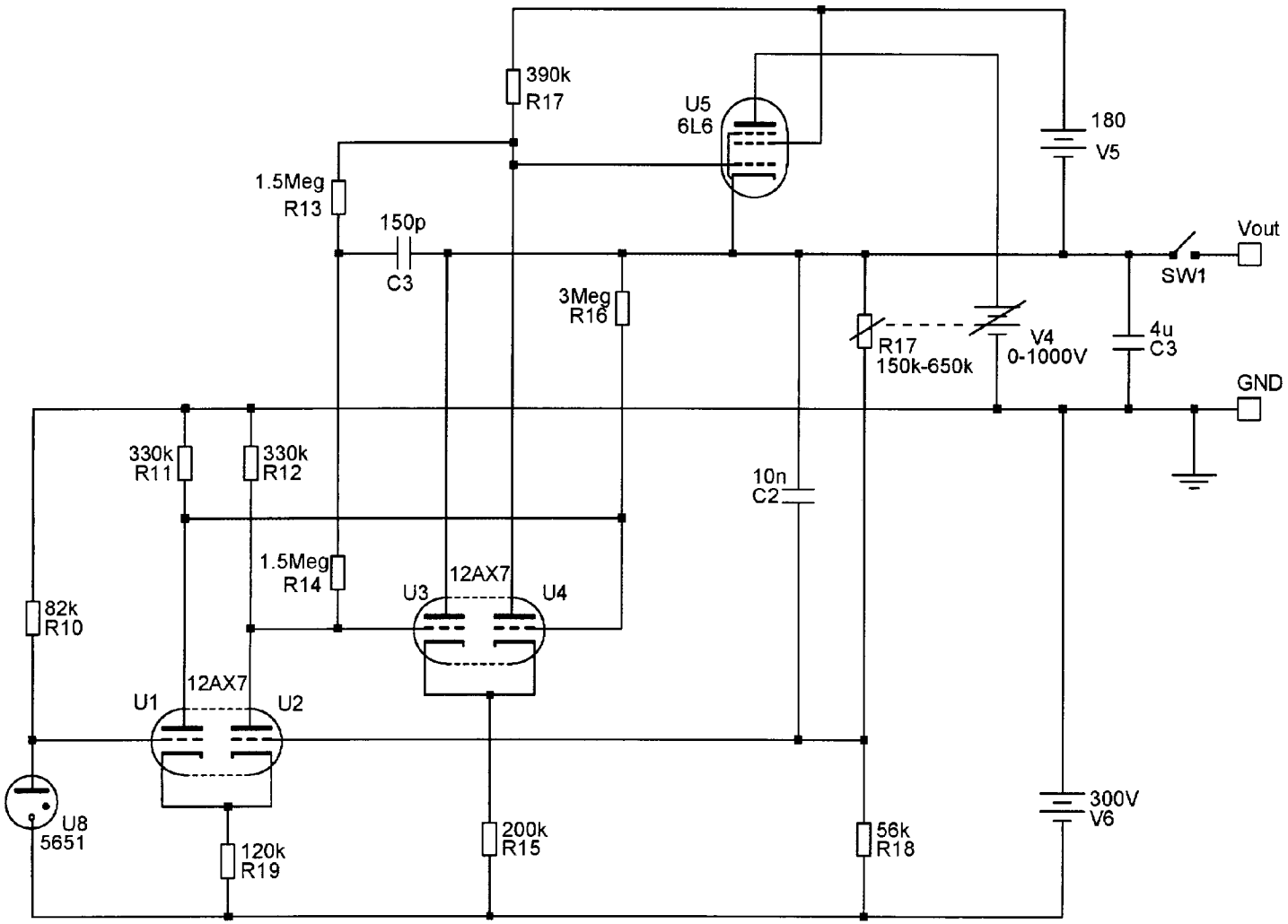
FIG. 4 (PRIOR ART)
FIG. 4 is a circuit diagram showing a prior art regulator implemented with thermionic devices.
Figure 5:
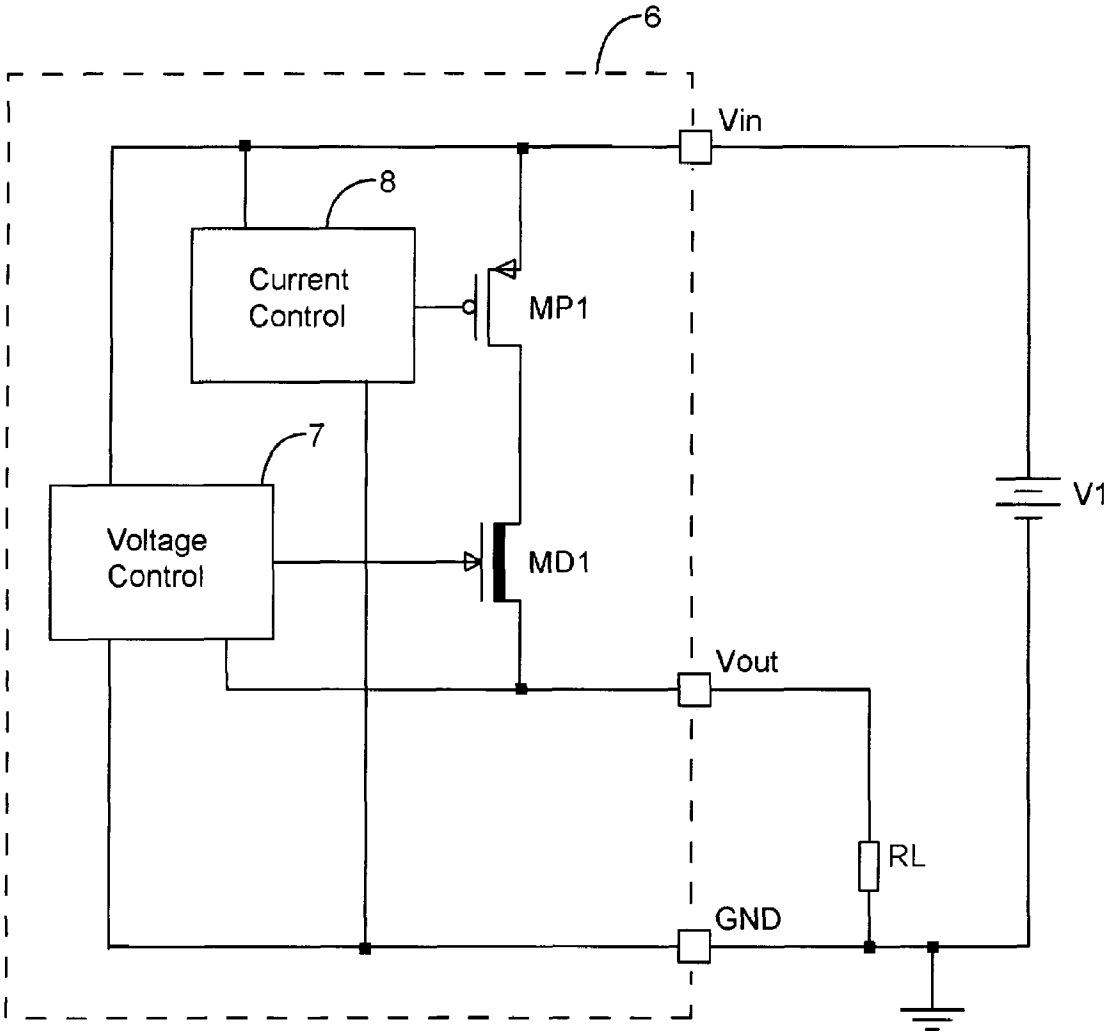
FIG. 5 is a general circuit diagram showing a NMOS depletion LDO regulator circuit in accordance with the present invention.

FIG. 5 shows the most general embodiment for the low dropout voltage regulator 6 using the depletion MOS transistor MP1 as main pass element.

The linear regulator 6 comprises a voltage control circuit 7 to control the voltage at the gate of the transistor MD1 in order to regulate the voltage at the load.

Furthermore a current control circuit 8 controls the voltage applied to the gate of PMOS device MP1 in order to control the current to the load.

According to the embodiment of the present invention, the depletion pass transistor MD1 is configured as a follower to allow the gate voltage to regulate the voltage at its source. Its back gate could be shorted to the source, but in a more common embodiment is connected to the substrate of the device. Because it is a depletion mode device, MD1 requires a negative voltage at its gate relative to its source in order to be turned fully off.

The PMOS device MP1 in series with pass device MD1 allows the current to the load to be controlled even when the gate of MD1 cannot be driven negative with respect to the output, such as when the Vout terminal is at ground potential. MP1 can be controlled to be a constant current to act as a conventional current limit, or it can be made to be a function of the output voltage or other parameters, as for example, in a fold-back current limit that decreases the current limit value in the case of a short-circuited load.

B. FIG. 6

Figure 6:
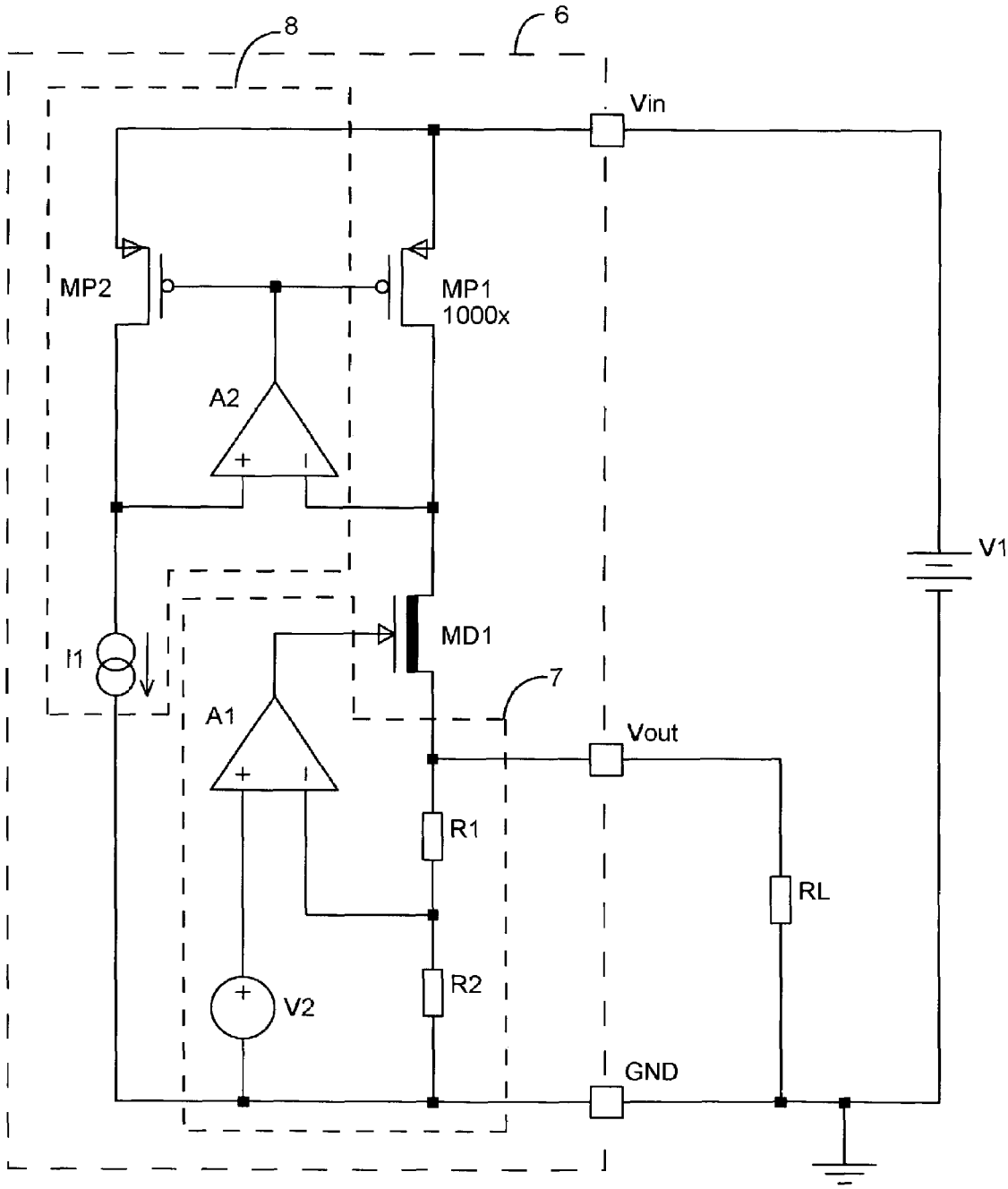
FIG. 6 is a circuit diagram showing a NMOS depletion LDO regulator circuit in accordance with the present invention.

FIG. 6 represents the general preferred embodiment for the low dropout voltage regulator using the depletion NMOS transistor as main pass element. FIG. 6 represents a more specific description of the system described in FIG. 5, with the current control block 8 and voltage control block 7 in FIG. 5 replaced with practical realizations.

The voltage control loop 7 of linear regulator 6 comprises a voltage reference circuit V2 having an output signal that connects to the non-inverting terminal of an operational amplifier A1, whose output controls the gate voltage of the main depletion pass transistor MD1 and whose inverting input connects to the feedback resistor divider implemented by R1 and R2.

The reference voltage V2 is most typically generated from a bandgap reference as is well known in the art. Other suitable references can also be derived, for example from a junction breakdown as with a zener diode, or from the difference between two dissimilar MOSFET or JFET thresholds. Although this reference is generally described as a constant voltage, this description does not preclude the use of a reference which has a functional value. For instance, a reference could be generated as a function of temperature to produce an output voltage Vout for regulator 6 which varies with temperature. Similarly, the reference voltage could be programmed, as with the output of a digital-to-analog converter, to make the regulator 6 programmable in output voltage.

The regulation is achieved by the operational amplifier A1 controlling the gate of MD1 in order to maintain the voltage at its two inputs at the same value. Therefore the output voltage will be regulated at the reference voltage multiplied by the resistor divider ratio.

The depletion NMOS transistor MD1 allows for a very low dropout voltage (difference between the input voltage and the output voltage) since its threshold is negative. With no substantive voltage between gate and source, as when V1 and Vout are at comparable levels, the NMOS MD1 will be turned fully on with a low resistance channel between drain and source.

Furthermore a large PMOS transistor MP1 is connected in series to the transistor MD1. Its gate is then connected to current control circuit 8 comprising a smaller PMOS MP2, current loop amplifier A2 and reference current I1. The transistors MP2 and MP1, together with the amplifier A2, form a current mirror with a gain determined by their channel width ratio, the channel length being preferably the same for both devices. The ratio of physical size is made preferably large, 1000 to 1 as shown in FIG. 6. Amplifier A2 works to force the current in MP2 to equal reference current I1 and for the voltage at the drain of MD1 and MD2 to be equal.

The operational amplifier A2 regulates the voltage at the drain of MD1 to be the same as the voltage at the drain of MP2. When the voltage at the drain of MD1 drops below the voltage at the drain of MP2 because the output current is approaching the current limit threshold, the operational amplifier A2 raises the voltage of the gate of MP1 and MP2 to control the current in the pass transistor MD1.

The current source I1 on the drain of MP2 is set to determine the output current limit as a multiple of the channel areas of MP1 and MP2. The generation of current sources is preferably independent of supply voltage and temperature, and is well known in the art of analog integrated circuits. The current source may also be made a function of input voltage, which can provide a constant power limiting, or can be made a function of temperature to increase the allowable dissipation when the die is cool, or as a function of the output voltage, to implement a fold-back limiting function. Other functional reasons for varying the current reference are foreseeable, and the general description of this current reference as a constant current source is not intended to limit such control of the current reference.

The regulator 6 will operate in one of two modes. When operating at a load current below the current limit, the output will be substantially controlled by the voltage control circuit 7. As the load current exceeds the current limit value, the output will be substantially controlled by the current control circuit 8.

When the current in the load is below the current limit, both PMOS MP1 and MP2 will be in the triode region. The effective resistance of the two devices will ratio as a function of their geometry, or 1000 to 1 as shown. When the current in MP1 and MD1 is substantially less than the current limit value, the drop across MP1 will be less than that across MP2. This will drive the inverting input of the amplifier A2 more positive than the non-inverting input, causing the output of amplifier A2 to swing low, further turning on both MP1 and MP2 until their gate voltages are substantially at ground potential. In this mode, MP1 is effectively turned on fully as a switch and MP1 plays no part in regulating the output.

When the current in the load increases to the value of current limit, the amplifier A2 actively regulates the current in MP1 as described above. Typically, as the current limit is reached, the output voltage will fall to a value below the ideal regulated voltage. The voltage at the inverting input of A1 decreases proportional to the output voltage. This drives the output of amplifier A1 positive and MD1 is turned fully on. The pass device MD1 becomes a fully enhanced switch in series with the current of the PMOS MP1 which effectively regulates the load.

C. FIG. 7

Figure 7:
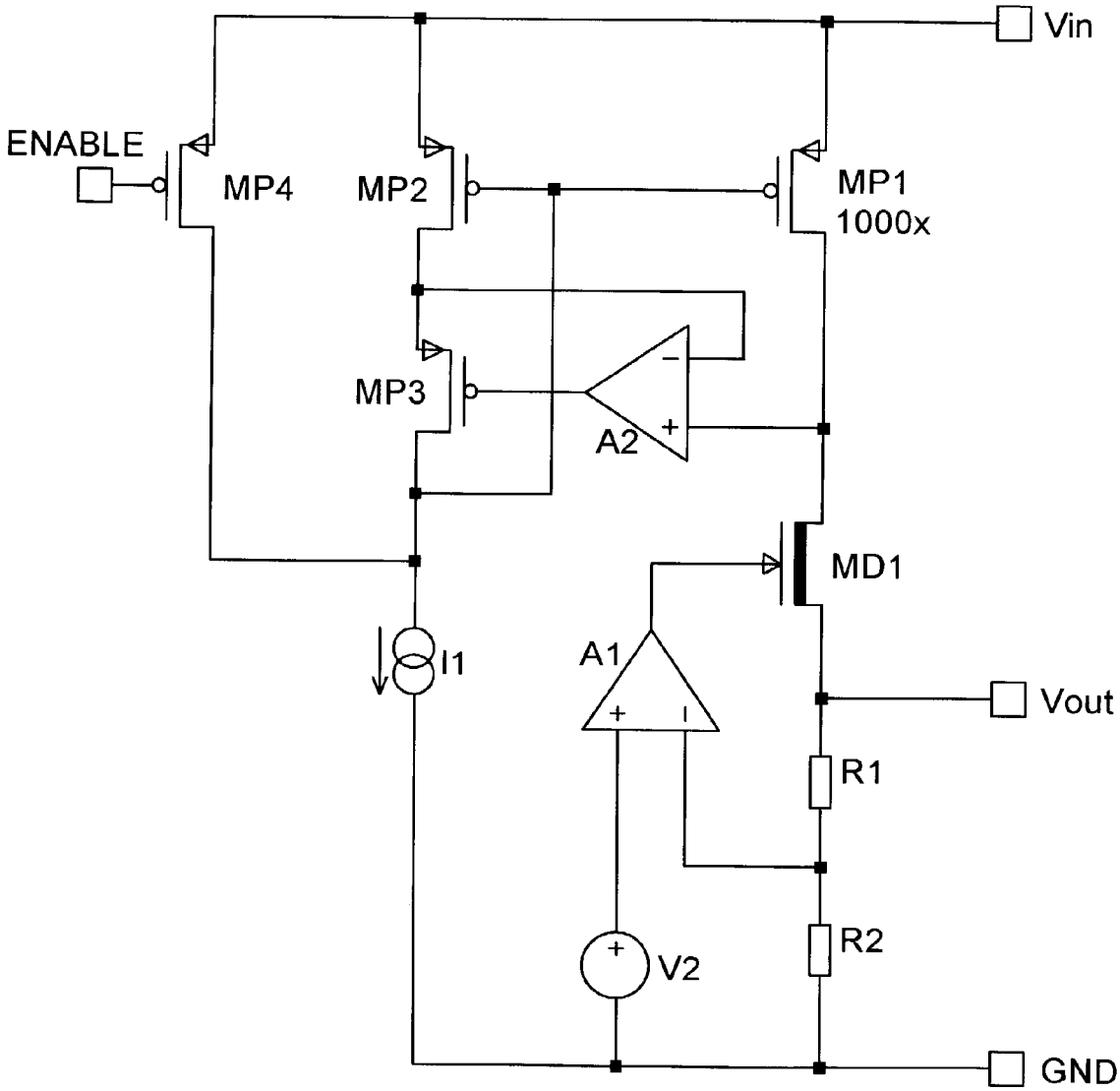
FIG. 7 is a circuit diagram showing a NMOS depletion LDO regulator circuit in accordance with the present invention.

FIG. 7 represents the first preferred embodiment for the low dropout voltage regulator using the depletion NMOS transistor MD1 as main pass element. This embodiment provides a more practical current control implementation than the general implementation of FIG. 6, and adds a logic input that can selectively enable or disable the operation of the regulator.

The linear regulator comprises a voltage reference circuit V2 having an output signal that connects to the non-inverting terminal of an operational amplifier A1, whose output controls the gate voltage of the main depletion pass transistor MD1 and whose inverting input connects to the feedback resistor divider implemented by R1 and R2. The voltage control loop so implemented is identical to that described above for FIG. 6.

Furthermore a large PMOS transistor MP1 is connected in series to the transistor MD1. Its gate is then connected to the gate of the PMOS transistor MP2 of the same type, but smaller channel size and to the drain of the PMOS transistor MP3 and to the output of current reference I1. The output of the current reference also connects to the drain of the PMOS transistor MP4. The gate of MP4 is connected to a terminal ENABLE which is used to selectively turn on or off the regulator. When ENABLE is substantially in the high state, then MP4 is off and the regulator works as previously described. When ENABLE is substantially low, the reference current from I1 is effectively shunted away from MP2 and MP3, such that MP1 is programmed for zero current and the regulator will produce no load current.

A second operational amplifier A2 has its inverting input connected to the drain of MP2, its non-inverting input connected to the drain of MD1 and its output to control the gate of the transistor MP3.

The amplifier A2 performs a function identical to that of A2 in FIG. 6, simultaneously forcing the current in MP2 to equal the reference current I1 and the drain voltage of MP2 to equal that of MP1. The inclusion of MP3 within this function simplifies stability of the loop by separating the control of these two simultaneous conditions. MP3 acts as a PMOS source follower, allowing the combination of amplifier A2 and PMOS MP3 to form a conventional unity gain follower forcing the drain voltage of MP2 to be substantially equal to the drain voltage of MP1, limited only to the input error on A2 as is well known in the design of operational amplifier circuits. Because the drain currents in MP2 and MP3 will be identical, any error between the value of current in MP2 relative to the magnitude of I1 will result in the difference in current flowing into the gates of MP1 and MP2. If MP2 is, for example, operating at a current slightly lower than the current reference I1, the excess current being sunk by I1 will flow from the gates of MP2 and MP1, lowering the voltage on the gates and therefore turning these devices on further. As the current in MP2 grows to equal that of I1, the gate current will reduce to zero and a stable condition will be reached.

A limitation of this current control circuitry compared to that of FIG. 5 is that the condition that drain voltages of MP1 and MP2 being held equal is maintained over a narrower range of voltages. As the voltage at the drain of MP1 falls below the voltage of the common gates of MP1 and MP2, amplifier A2 drives the gate of MP3 substantially to ground, turning on MP3 fully as a switch. The circuit thus formed will be recognized as a simple two transistor current mirror with the drain and gate of MP2 being effectively connected together through the low impedance of switch MP3. In this configuration, the circuit continues to operate as described above but the current in MP1 will have an error due to output impedance as is well known in simple current mirrors.

D. FIG. 8

Figure 8:
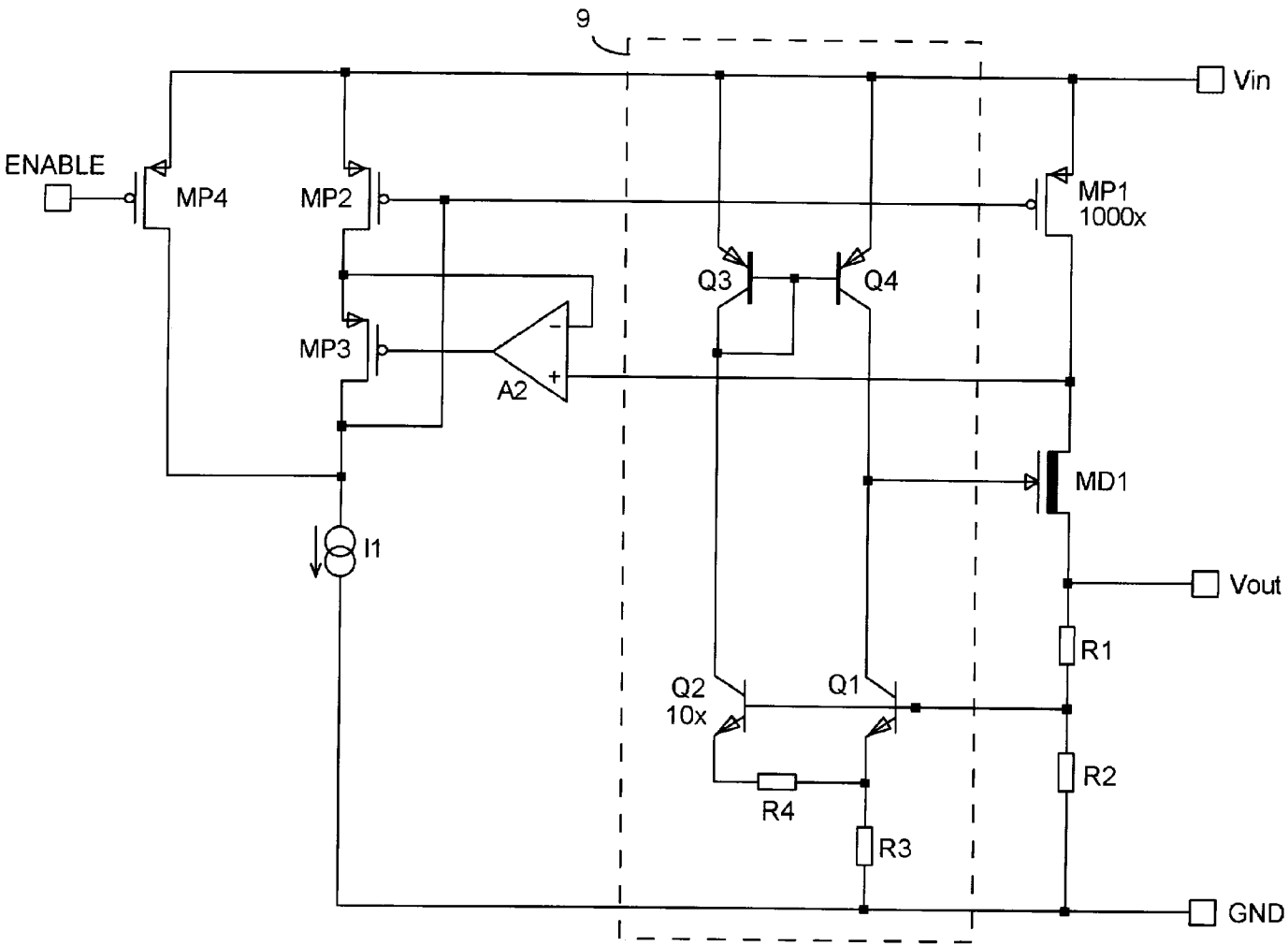
FIG. 8 is a circuit diagram showing a NMOS depletion LDO regulator circuit combining the error simplifier and voltage reference functions in accordance with the present invention.

FIG. 8 displays another embodiment of the present invention for the low dropout voltage regulator using the depletion NMOS MD1 transistor as main pass element. This embodiment is similar to that of FIG. 7 but demonstrates that the functions of the error amplifier A1 and the reference voltage V2 of previous figures can be practically merged.

The linear regulator includes a voltage reference circuit 9 (of the type analogous to the Brokaw band-gap cell). The voltage reference appears at the gate of the NPN transistors Q1 and Q2, Q2 having its emitter area 10 times greater than the emitter area of Q1. The resistor R4 is connected to the emitter of Q2 and to the emitter of Q1 and the resistor R3 is connected between emitter of Q1 and ground. The PNP transistors Q3 and Q4 are connected in a current mirror configuration of conventional design to force Q1 and Q2 to operate at substantially equal current. The gate of the depletion NMOS pass transistor is connected to the collectors of Q1 and Q2.

Furthermore a large PMOS transistor MP1 and related current control circuitry is connected in series to the transistor MD1 and it operates as described for the case of the embodiment of FIG. 7.

Voltage regulation is achieved as the Brokaw cell band-gap circuit 10 controls the voltage at the gate of MD1, in order to maintain the voltage at the mid point of the resistor divider R1–R2 at the band-gap voltage (1.23V). Therefore the output voltage will be regulated at the reference voltage (typically the band-gap voltage) multiplied by the resistor divider ratio. As the voltage at the bases of Q1 and Q2 deviate from this preferred value, the collector currents in Q1 and Q2 become unbalanced. The collector current in Q4 is substantially equal to the collector currents of Q2 and Q3, and will therefore become unbalanced with respect to the collector current in Q1. This current imbalance creates a net current either charging or discharging the gate of MD1, which will change the voltage at Vout until the voltage at the bases of Q1 and Q2 regain their preferred value that will again balance their collector currents.

The transistor MP4 simply operates as a switch to disable the regulator guaranteeing zero output current as in the case of the embodiment shown in FIG. 7.

E. FIG. 9

Figure 9:
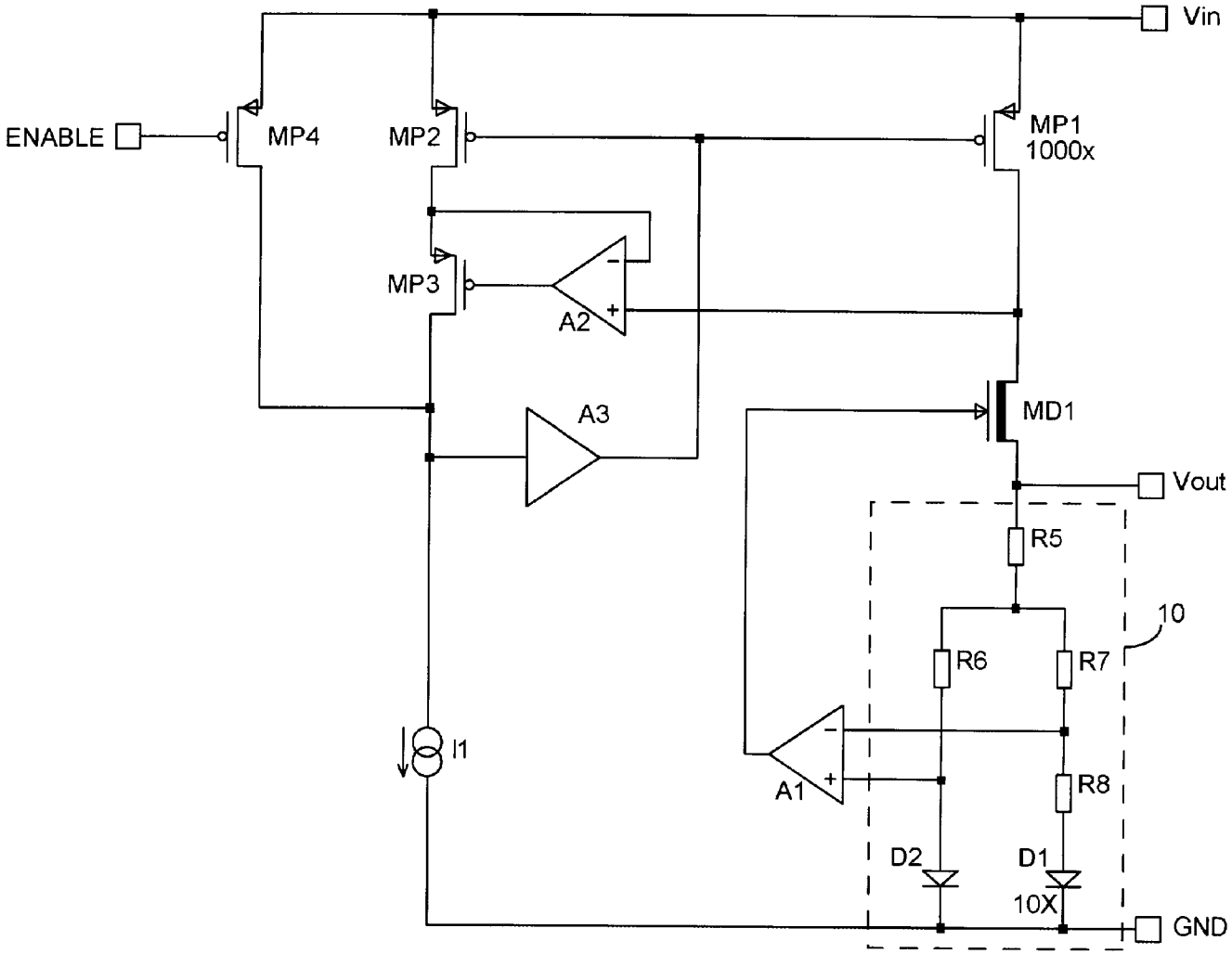
FIG. 9 is a circuit diagram showing a NMOS depletion LDO regulator circuit combining the voltage divider and voltage reference functions in accordance with the present invention.

FIG. 9 shows one alternative embodiment for the low dropout voltage regulator using the depletion MOS transistor MD1 as main pass element. This embodiment is similar to that of FIG. 7 but demonstrates that the functions of the voltage reference V2 and the voltage divider R1 and R2 of previous figures can be practically merged. This implementation also shows a further improvement in the current control loop.

The linear regulator includes a Bandgap reference circuit 10 having two diodes D1 and D2, with D1 area ten times the area of D2 with their anode connected to ground. The cathode of D1 is further connected to the resistor R8, while the cathode of D2 is connected to the resistor R6 and to the non-inverting input of the operational amplifier A1 whose inverting input is connected to the resistors R8 and R7 and its output to the gate of the depletion NMOS pass transistor MD1.

Furthermore a large PMOS transistor MP1 is connected in series to the depletion pass transistor MD1 and it operates as described the embodiment of FIG. 7. Its gate is connected to the transistor MP2 of the same type, but smaller channel size and to the output of the operational amplifier A3.

A second operational amplifier A2 operates as described for the embodiment of FIG. 7.

A non-inverting amplifier A3 acts as a voltage buffer to generate a voltage shift of the voltage at the drain of MP3 to the gate of the transistors MP1 and MP2. This amplifier maintains its input voltage at a substantially low value such that the PMOS MP3 will not enter the triode region as the drain of MP1 drops in voltage when the regulator is in current limit.

The voltage reference is generated at the node that connects the resistor RS, R6 and R7. Resistors R6 and R7 are preferably made substantially equal. The regulation is achieved as amplifier A1 controls the gate of MD1 in order to maintain the voltage at its two inputs at the same value. The current in the two diodes D1 and D2 is substantially equal and the voltage across R8 is substantially the temperature dependent ΔVd that occurs when operating diodes at differing current densities. The voltage at Vout when the inputs of A1 are substantially equal is the sum of a diode voltage and of a voltage which is a scaled version of said ΔVd. The negative temperature coefficient of the diode voltages can be balanced against the positive temperature coefficient voltage imposed across the resistors. This balance occurs when the resistors are adjusted such that the total voltage is approximately 1.23V, the bandgap of silicon.

The series PMOS MP1 connected to the drain of MD1 operates as described for the embodiment of FIG. 7.

The transistor MP4 operates as described for the embodiment of FIG. 7.

Although the present invention has been described above with particularity, this was merely to teach one of ordinary skill in the art how to make and use the invention. Many additional modifications will fall within the scope of the invention. Thus, the scope of the invention is defined by the claims which immediately follow.

What is claimed is:

1. A liner voltage regulator comprising:

an input terminal means for receiving power;

an output terminal means for supplying current to a load;

a common terminal means for receiving power and supplying power to said load;

a depletion MOS first transistor having a drain, a source, and a gate, said source being coupled to said output terminal means and said gate being coupled to a first controlling signal;

an enhancement MOS second transistor with a source, a drain and a gate, said source of said second transistor coupled to said input terminal means, said drain of said second transistor coupled to said drain of said first transistor and said gate of said second transistor coupled to a second controlling signal;

wherein said depletion MOS first transistor constitutes the main element for regulating the voltage at said output terminal means;

wherein said enhancement MOS second transistor constitutes the main element for limiting the current supplied to said output terminal means; and whereby said linear voltage regulator achieves a low dropout voltage.

2. The linear voltage regulator of claim 1 wherein said first transistor is a depletion N-channel MOS transistior.

3. The lineat voltage regulator of claim 1 further comprising:

a reference circuit with a reterende output voltage, a feedback means with a feedback signal responsive to the voltage between said output terminal means and said common terminal means; and an error amplifier circuit for generating said first controlling signal as a function of the difference between said reference output voltage and said feedback signal.

4. The linear voltage regulator of claim 1 wherein said enhancement MOS second transistor is an enhancement P-channel MOS transistor.

* * * * *